US010610770B2

(12) United States Patent
Chen et al.

(10) Patent No.: US 10,610,770 B2
(45) Date of Patent: Apr. 7, 2020

(54) METHOD AND DEVICE FOR DISPLAYING INFORMATION OF A PHYSICAL GAME PARTICIPANT AND A REMOTE CONTROLLED VEHICLE

(71) Applicant: SZ DJI TECHNOLOGY CO., LTD., Shenzhen (CN)

(72) Inventors: Shengyang Chen, Shenzhen (CN); Yijun Guan, Shenzhen (CN); Jidong Wei, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 322 days.

(21) Appl. No.: 15/413,454

(22) Filed: Jan. 24, 2017

(65) Prior Publication Data

US 2017/0128824 A1 May 11, 2017

Related U.S. Application Data

(63) Continuation of application No. PCT/CN2014/083478, filed on Jul. 31, 2014.

(51) Int. Cl.

| | |
|---|---|
| ***A63F 9/00*** | (2006.01) |
| ***A63H 17/045*** | (2006.01) |
| ***A63F 9/02*** | (2006.01) |
| ***A63H 23/00*** | (2006.01) |
| ***A63H 27/00*** | (2006.01) |

(Continued)

(52) U.S. Cl.

CPC ..... *A63F 9/00* (2013.01); *A63F 9/02* (2013.01); *A63F 9/24* (2013.01); *A63H 17/045* (2013.01); *A63H 23/00* (2013.01); *A63H 27/00* (2013.01); *A63H 30/04* (2013.01); *A63F 2011/0058* (2013.01); *A63F 2011/0072* (2013.01); *A63F 2250/52* (2013.01)

(58) Field of Classification Search

CPC ..... A63F 9/00; A63F 9/24; A63F 9/02; A63F 2011/0072; A63F 2011/0058; A63F 2250/52; A63H 30/04; A63H 23/00; A63H 27/00; A63H 17/045

See application file for complete search history.

(56) References Cited

U.S. PATENT DOCUMENTS 5,100,153 A * 3/1992 Welte ..... A63H 17/006 124/29
6,171,171 B1 * 1/2001 Barthold ..... A63H 17/28 446/219

(Continued)

FOREIGN PATENT DOCUMENTS

CN 201171909 Y 12/2008
CN 101406756 A 4/2009

(Continued)

OTHER PUBLICATIONS

The World Intellectual Property Organization (WIPO) International Search Report for PCT/CN2014/083478 dated May 6, 2015 p. 1-6.

*Primary Examiner* — Kevin Y Kim
(74) *Attorney, Agent, or Firm* — Anova Law Group, PLLC

(57) ABSTRACT

A method for displaying information of a physical game participant includes obtaining information of the physical game participant and controlling an LED light-emitting device to generate a corresponding lighting form based on the information.

17 Claims, 6 Drawing Sheets

(51) Int. Cl.

| | |
|---|---|
| ***A63H 30/04*** | (2006.01) |
| ***A63F 9/24*** | (2006.01) |
| ***A63F 11/00*** | (2006.01) |

(56) References Cited

U.S. PATENT DOCUMENTS

| | | | | |
|---|---|---|---|---|
| 6,254,486 | B1 | 7/2001 | Mathieu | |
| 2002/0142701 | A1 | 10/2002 | Rosenberg | |
| 2003/0168811 | A1 | 9/2003 | Gerson | |
| 2004/0145886 | A1 | 7/2004 | Fatemi et al. | |
| 2010/0003886 | A1* | 1/2010 | Cheng | A63H 27/12 446/37 |
| 2014/0316614 | A1* | 10/2014 | Newman | G06Q 30/0611 701/3 |

FOREIGN PATENT DOCUMENTS

| | | | |
|---|---|---|---|
| CN | 102376177 | A | 3/2012 |
| CN | 102430241 | A | 5/2012 |
| CN | 202387233 | U | 8/2012 |
| CN | 202650010 | U | 1/2013 |
| CN | 202876351 | U | 4/2013 |
| EP | 0616188 | A1 | 9/1994 |
| JP | 2006346144 | A | 12/2006 |

* cited by examiner

METHOD AND DEVICE FOR DISPLAYING INFORMATION OF A PHYSICAL GAME PARTICIPANT AND A REMOTE CONTROLLED VEHICLE

CROSS-REFERENCE TO RELATED APPLICATION

This is a continuation application of International Application No. PCT/CN2014/083478, filed on Jul. 31, 2014, the entire contents of which are incorporated herein by reference.

TECHNICAL FIELD

The present disclosure relates to a method for displaying information of a physical game, and in particular, to a method and device for displaying information of a physical game participant and a remote controlled vehicle.

BACKGROUND

In a physical game, a physical game participant can participate in a match. For example, a plurality of remote controlled vehicles can participate in a shooting competition. In the competition, a health point of each remote controlled vehicle is generally provided by a scoreboard.

However, conventional method of displaying a health point of a remote controlled vehicle is not optimal. For instance, a viewer has to correlate a number displayed on the scoreboard with a number plate of a remote controlled vehicle on the ground in order to know a health point of the remote controlled vehicle. For another instance, the viewer has to switch attention between the ground and the scoreboard, leading a potential mistake in recognizing a remote controlled vehicles and a health point displayed on the scoreboard.

SUMMARY

The present disclosure provides a method of displaying information of a physical game participant such as a remote controlled vehicle.

In one aspect, the present disclosure provides a method for displaying information of a physical game participant. The method can comprise obtaining information of the physical game participant, and controlling an LED light-emitting device to generate a corresponding lighting form based on the information.

The method for displaying information of the physical game participant of present disclosure is advantageous over conventional art.

In an aspect, with the method for displaying information, information of the physical game participant can be displayed by lighting of the LED light-emitting device. The LED light-emitting device can be fixed directly on the physical game participant, such that a viewer can know intuitively information of the physical game participant. For instance, state information of the physical game participant, such as health point, can be displayed by the LED light-emitting device such that the health point of the physical game participant can be directly known.

In another aspect, with the method for displaying information, the LED light-emitting device can be controlled to generate various lighting forms, such that various information of the physical game participant can be displayed and an applicability can be improved.

In some embodiments, the information can comprise at least one of state information of the physical game participant, control information of the physical game participant or identity information of the physical game participant.

In some embodiments, the state information of the physical game participant can comprise at least one of a health point, touching landmine, an obstacle or a trap, being frozen, or being dizzied.

In some embodiments, the control information of the physical game participant can comprise at least one of a movement information of the physical game participant or an attack information of the physical game participant.

In some embodiments, the movement information of the physical game participant can comprise at least one of a movement of the physical game participant in a front direction, a rear direction, a left direction, a right direction, an acceleration, or a deceleration.

In some embodiments, the identity information of the physical game participant can comprise at least one of a participant category information and a battle achievement information.

In some embodiments, the participant category information can comprise at least one of an attacker, a defender or a referee.

In some embodiments, the battle achievement information can comprise at least one of a time information and a quantity information.

In some embodiments, the quantity information can comprise at least one of a number of times hitting a counterpart physical game participant or a number of times destroying a counterpart physical game participant.

In some embodiments, the time information can comprise at least one of duration of surviving, a duration of continuous attacking or a duration of continuous defensing.

In some embodiments, the information can be obtained from at least one of a sensor provided on the physical game participant, a sensor provided on a counterpart physical game participant, or a master controller.

In some embodiments, the physical game participant can comprise at least one of a remote controlled water vehicle, a remote controlled underwater vehicle, a remote controlled aerial vehicle, a remote controlled ground vehicle, or a ground stationery facility.

In some embodiments, the lighting form can comprise at least one of a lighting color of the LED light-emitting device, a lighting state of the LED light-emitting device, an arrangement of light-emitting LEDs of the LED light-emitting device, or a lighting duration of the LED light-emitting device.

In some embodiments, the LED light-emitting device can comprise an LED light bar having a plurality of LEDs. The plurality of LEDs can comprise at least one of an inorganic light-emitting diode or a laser diode. The LED light bar can further comprise an LED base plate on which the plurality of LEDs are disposed. Alternatively, the plurality of LEDs can be OLEDs. The LED light bar can be a light-emitting plate having a plurality of light-emitting units of the plurality of OLEDs.

In some embodiments, the plurality of LEDs can be RGB-LEDs or monochrome LEDs.

In some embodiments, the plurality of LEDs can be arranged in a straight line or in a matrix.

In some embodiments, the LED light-emitting device can further comprise a housing within which the LED light bar is mounted.

In some embodiments, the housing can comprise a base, a supporting frame, a light transmitting panel and a top fixing member. Two ends of the supporting frame can be fixedly connected with the base and the top fixing member, respectively. The light transmitting panel can be fixedly connected with the supporting frame to form an enclosed light source chamber with the base and the top fixing member. The LED light bar can be received within the light source chamber.

In some embodiments, the top fixing member can be a seat for a camera.

In some embodiments, the supporting frame can comprise a left frame body and a right frame body which are disposed oppositely with a spacing. Two ends of the left frame body and two ends of the right frame body can be fixedly connected with the base and the top fixing member, respectively.

In some embodiments, a plurality of light transmitting panels can be provided. The plurality of light transmitting panels can comprise two first side plates which are fixed on the left frame body and the right frame body, respectively.

In some embodiments, the plurality of light transmitting panels can further comprise a second side plate, two ends of the second side plate being fixedly connected with the base and the top fixing member, respectively, and the second side plate being jointed to respective side of the two first side plates.

In some embodiments, a stopper can be provided to a side of the left frame body and a side of the right frame body, respectively, the side of the left frame body and the side of the right frame body abutting against the second side plate. The stopper can extend and bend from an edge of the left frame body and an edge of the right frame body to limit a movement of the second side plate.

In some embodiments, the plurality of light transmitting panel can further comprise a third side plate which is disposed opposite to the second side plate, two ends of the third side plate being fixedly connected with the base and the top fixing member, respectively.

In some embodiments, the third side plate can comprise an upper plate, a middle plate and a lower plate, one end of the middle plate being fixedly connected with the lower plate, and the other end of the middle plate being detachably connected with the upper plate.

In some embodiments, a lower fixing member can be provided on the base, an upper fixing member can be provided on the top fixing member. Two ends of the LED light bar can be fixedly connected with the upper fixing member and the lower fixing member, respectively, such that the LED light bar can be fixed within the light source chamber.

In some embodiments, the LED light-emitting device can comprise an LED light bar, the LED light bar comprising a group of wires and a plurality of LEDs that are connected in parallel on the group of wires. The plurality of LEDs can comprise at least one of an inorganic light-emitting diode or a laser diode.

In some embodiments, a plurality of the LED light bars can be provided, the plurality of LED light bars being arranged in a row or in a matrix.

In some embodiments, the housing can be provided in a cylinder structure, a flat plate structure, a truncated cone structure, a truncated prism structure, a prism structure, or an arc structure.

In some embodiments, the information can be a health point of the physical game participant and the LEDs can be RGB-LEDs, a change in the health point of the physical game participant being displayed by controlling a change in lighting color of the plurality of RGB-LEDs. Alternatively, the information can be a health point of the physical game participant and the LEDs can be monochrome LEDs, a change in the health point of the physical game participant being displayed by controlling a light-on and a light-off of the plurality of monochrome LEDs.

In some embodiments, if multiple pieces of information are received, the multiple pieces of information can be sequentially displayed by the LED light-emitting device in an order of receiving the information. Alternatively, if multiple pieces of information are received, the multiple pieces of information can be sequentially displayed by the LED light-emitting device in an order of a preset priority of the information.

In some embodiments, if multiple pieces of information are received, the multiple pieces of information can be displayed by the LED light-emitting device simultaneously.

In some embodiments, when new information is received, the new information can be displayed immediately by the LED light-emitting device. Alternatively, when new information is obtained, the new information can be displayed by the LED light-emitting device after a preset time period. Alternatively, when new information is obtained, the new information can be displayed by the LED light-emitting device after a preset time period.

In some embodiments, when new information is received, the new information can be displayed immediately by the LED light-emitting device, and a previous information can be displayed simultaneously.

In some embodiments, the process of controlling the LED light-emitting device to generate a corresponding lighting form based on the information can further comprise: determining whether a first preset displaying duration for displaying a previous information is reached; and if the first preset displaying duration for displaying the previous information is reached, displaying immediately the new information by the LED light-emitting device.

In some embodiments, the process of controlling the LED light-emitting device to generate a corresponding lighting form based on the information can comprises: if the first preset displaying duration for displaying the previous information is not reached, determining whether a priority of the new information is higher a priority of the previous information; and if the priority of the new information is higher than the priority of the previous information, displaying immediately the new information by the LED light-emitting device.

In some embodiments, the process of controlling the LED light-emitting device to generate a corresponding lighting form based on the information can comprises: if the priority of the new information is not higher than the priority of the previous information, displaying the new information by the LED light-emitting device after the first preset displaying duration for displaying the previous information is reached.

In some embodiments, the process of controlling the LED light-emitting device to generate a corresponding lighting form based on the information can comprises: after a second preset displaying duration for displaying the new information is reached, determining whether the previous information is to be displayed; and if the previous information is to be displayed, displaying immediately the previous information by the LED light-emitting device.

In some embodiments, the process of controlling the LED light-emitting device to generate a corresponding lighting form based on the information can comprise: if the previous information is not to be displayed, determining whether there the new information is to be continuously displayed;

and the new information is to be continuously displayed, displaying immediately the new information by the LED light-emitting device.

In some embodiments, obtaining the information of the physical game participant comprises: determining whether new information is received; and if no new information is received, displaying a previous information by the LED light-emitting device, and if new information is received, performing a next process.

In another aspect, the present disclosure provides a display device for displaying information of a physical game participant.

The display device for displaying information of a physical game participant can comprise: an LED light-emitting device comprising an LED light bar for generating a plurality of lighting form; and an LED control circuit for controlling the LED light bar, such that the LED light-emitting device generates a corresponding lighting form to display the information of the physical game participant.

The display device for displaying information of a physical game participant of present disclosure is advantageous over conventional art.

In an aspect, the display device can display information of the physical game participant by lighting of the LED light-emitting device. The LED light-emitting device can be fixed directly on the physical game participant, such that a viewer can know intuitively information of the physical game participant. For instance, state information of the physical game participant, such as health point, can be displayed by the LED light-emitting device, such that the health point of the physical game participant can be directly known.

In another aspect, the display device can control the LED light-emitting device to generate various lighting forms by the LED control circuit, such that various information of the physical game participant can be displayed and an applicability can be improved.

In some embodiments, the LED light-emitting device can comprise an LED light bar having a plurality of LEDs. The plurality of LEDs can comprise at least one of an inorganic light-emitting diode or a laser diode. The LED light bar can further comprise an LED base plate on which the plurality of LEDs are disposed. Alternatively, the plurality of LEDs can be OLEDs. The LED light bar can be a light-emitting plate having a plurality of light-emitting units of the plurality of OLEDs.

In some embodiments, the plurality of LEDs can be RGB-LEDs or monochrome LEDs.

In some embodiments, the plurality of LEDs can be arranged in a straight line or in a matrix.

In some embodiments, the LED light-emitting device can further comprise a housing within which the LED light bar is mounted.

In some embodiments, the housing can comprise a base, a supporting frame, a light transmitting panel and a top fixing member. Two ends of the supporting frame can be fixedly connected with the base and the top fixing member, respectively. The light transmitting panel can be fixedly connected with the supporting frame to form an enclosed light source chamber with the base and the top fixing member. The LED light bar can be received within the light source chamber.

A frame of the display device comprises the base and the supporting frame, and the light transmitting panels are provided surrounding the frame of the display device. A strength of the light transmitting panels can be improved. The light transmission of the light transmitting panels is not affected by the frame of the display device. The housing of the display device has a stable structure and satisfactory light transmission.

In some embodiments, the top fixing member can be a seat for a camera.

In some embodiments, the supporting frame can comprise a left frame body and a right frame body which are disposed oppositely with a spacing. Two ends of the left frame body and two ends of the right frame body can be fixedly connected with the base and the top fixing member, respectively.

In some embodiments, a plurality of light transmitting panels can be provided. The plurality of light transmitting panels can comprise two first side plates which are fixed on the left frame body and the right frame body, respectively.

In some embodiments, the plurality of light transmitting panels can further comprise a second side plate, two ends of the second side plate being fixedly connected with the base and the top fixing member, respectively. The second side plate can be jointed to respective side of the two first side plates.

In some embodiments, a stopper can be provided to a side of the left frame body and a side of the right frame body, respectively, the side of the left frame body and the side of the right frame body abutting against the second side plate. The stopper can extend and bend from an edge of the left frame body and an edge of the right frame body to limit a movement of the second side plate.

In some embodiments, the plurality of light transmitting panel can further comprise a third side plate which is disposed opposite to the second side plate, two ends of the third side plate being fixedly connected with the base and the top fixing member, respectively.

In some embodiments, the third side plate can comprise an upper plate, a middle plate and a lower plate, one end of the middle plate being fixedly connected with the lower plate, and the other end of the middle plate being detachably connected with the upper plate.

In some embodiments, a lower fixing member can be provided on the base, an upper fixing member can be provided on the top fixing member. Two ends of the LED light bar can be fixedly connected with the upper fixing member and the lower fixing member, respectively, such that the LED light bar is fixed within the light source chamber.

In some embodiments, the LED light bar can comprise a group of wires and a plurality of LEDs that are connected in parallel on the group of wires. The plurality of LEDs can comprise at least one of an inorganic light-emitting diode or a laser diode.

In some embodiments, a plurality of the LED light bars can be provided, the plurality of LED light bars being arranged in a row or in a matrix.

In some embodiments, the housing can be provided in a cylinder structure, a flat plate structure, a truncated cone structure, a truncated prism structure, a prism structure, or an arc structure.

In some embodiments, the physical game participant can comprise at least one of a remote controlled water vehicle, a remote controlled underwater vehicle, a remote controlled aerial vehicle, a remote controlled ground vehicle, or a ground stationery facility.

In some embodiments, the information can comprise at least one of a state information of the physical game participant, a control information of the physical game participant or an identity information of the physical game participant.

In some embodiments, the state information of the physical game participant can comprise at least one of a health point, touching landmine, an obstacle or a trap, being frozen, or being dizzied.

In some embodiments, the control information of the physical game participant can comprise at least one of a movement information of the physical game participant or an attack information of the physical game participant.

In some embodiments, the movement information of the physical game participant can comprise at least one of a movement of the physical game participant in a front direction, a rear direction, a left direction, a right direction, an acceleration, or a deceleration.

In some embodiments, the identity information of the physical game participant can comprise at least one of a participant category information and a battle achievement information.

In some embodiments, the participant category information can comprise at least one of an attacker, a defender or a referee.

In some embodiments, the battle achievement information can comprise at least one of a time information and a quantity information.

In some embodiments, the quantity information can comprise at least one of a number of times hitting a counterpart physical game participant or a number of times destroying a counterpart physical game participant.

In some embodiments, the time information can comprise at least one of duration of surviving, a duration of continuous attacking or a duration of continuous defensing.

In another aspect, the present disclosure provides a remote controlled vehicle in which the above described display device is employed.

The remote controlled vehicle can comprise: the above described display device; a sensing device for sensing a state of the remote controlled vehicle and generating corresponding state information; and a controller in communication connection with the LED control circuit and the sensing device. The controller can receive the state information and outputs a corresponding control signal to the LED control circuit based on the state information.

The remote controlled vehicle of present disclosure is advantageous over conventional art.

In an aspect, in the remote controlled vehicle, information of the physical game participant can be displayed by lighting of the LED light-emitting device. The LED light-emitting device can be fixed directly on the physical game participant, such that a viewer can know intuitively information of the physical game participant. For instance, state information of the physical game participant, such as health point, can be displayed by the LED light-emitting device, such that the health point of the physical game participant can be directly known.

In another aspect, in the remote controlled vehicle, the LED light-emitting device can be controlled to generate various lighting forms by the LED control circuit, such that various information of the physical game participant can be displayed and an applicability can be improved.

In still another aspect, in the remote controlled vehicle, the controller can control the LED light-emitting device to display multiple pieces of state information of the remote controlled vehicle in different orders and/or different patterns by the LED control circuit, such that a manipulation of the remote controlled vehicle is easier.

In some embodiments, the sensing device can comprise a sensor disposed on an outer surface of the remote controlled vehicle, the sensor sensing whether an external projectile hits the outer surface of the remote controlled vehicle.

In some embodiments, the sensor can comprise at least one of an acceleration sensor, an infrared ray sensor, a motion sensor, a proximity sensor, a vision sensor, a position sensor, or a distance sensor.

In some embodiments, the state information can be a health point of the remote controlled vehicle and the LEDs can be RGB-LEDs. The controller can change a lighting color of the plurality of RGB-LEDs by the LED control circuit based on a change in the health point of the remote controlled vehicle. Alternatively, the state information can be the health point of the remote controlled vehicle and the LEDs can be monochrome LEDs. The controller can control a light-on and a light-off of the plurality of monochrome LEDs by the LED control circuit based on a change in the health point of the remote controlled vehicle.

In some embodiments, if the controller receives multiple pieces of state information, the controller can control the LED light-emitting device to sequentially display the multiple pieces of state information in an order of receiving the multiple pieces of state information. Alternatively, if the controller receives multiple pieces of state information, the controller can control the LED light-emitting device to sequentially display the multiple pieces of state information in an order of a preset priority of the multiple pieces of state information.

In some embodiments, if the controller receives multiple pieces of state information, the controller can control the LED light-emitting device to display the multiple pieces of state information simultaneously.

In some embodiments, when the controller receives new state information, the controller can control the LED light-emitting device to immediately display the new state information. Alternatively, when the controller receives a new sate information, the controller can control the LED light-emitting device to immediately display the new state information, and display a previous state information after a preset time period. Alternatively, when the controller receives new state information, the controller can control the LED light-emitting device to display the new state information after a preset time period.

In some embodiments, when the controller receives new state information, the controller can control the LED light-emitting device to display the new state information and a previous state information simultaneously.

In some embodiments, the controller can comprise at least one of a microprocessor, a control circuit board, or an IC controller.

In some embodiments, the controller and the LED control circuit can be integrated or separately disposed.

In some embodiments, the state information of the remote controlled vehicle can comprise at least one of a health point, touching landmine, obstacle or trap, being frozen, or being dizzied.

DETAILED DESCRIPTION OF THE EMBODIMENTS

Figure 1:
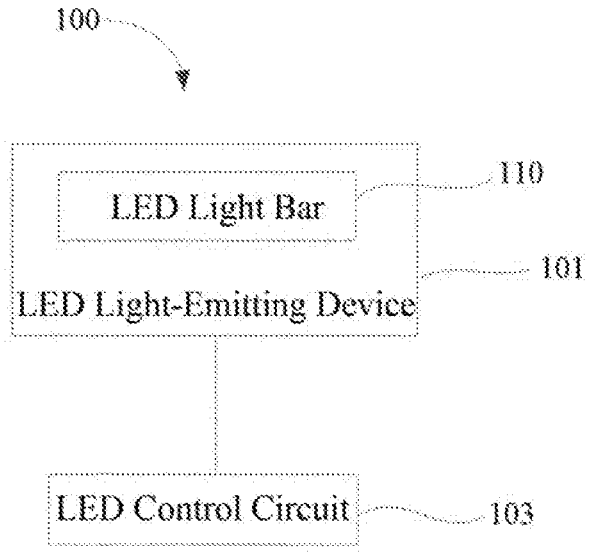
FIG. 1 is a circuit diagram of a display device for displaying information of a physical game participant according to an embodiment of the disclosure.

Technical solutions of the present disclosure will be described with reference to the drawings. It will be appreciated that embodiments as described in the disclosure are simple a part rather than all of the embodiments of the present disclosure. Other embodiments, which are conceived by those having ordinary skills in the art on the basis of the disclosed embodiments without inventive efforts, should fall within the scope of the present disclosure.

It will be appreciated that, when an element is described to be "fixed to" another element, it can be directly fixed to another element or through an intermediate element. When an element is described to be "connected to" another element, it can be directly connected to another element or through an intermediate element. Terms "vertical", "horizontal", "left", "right" and other expressions are merely for illustrative purposes.

Unless otherwise specified, the technical terms and scientific terms as used in the disclosure have the ordinary meaning to those skilled in the technical fields to which the present disclosure belongs. The terms in the disclosure are used to describe embodiments of the disclosure, with no intent to limit the disclosure. The term 'and/or' as used in the disclosure includes any and all combination(s) of one or more listed items.

The present disclosure provides a method for displaying information of a physical game participant. In the method, information can be displayed by an LED light-emitting device which can generate various lighting forms to display various types of information.

The physical game participant can be various devices for participating in a physical game. For instance, the physical game participant can be a remote controlled ground vehicle, such as a remote controlled toy vehicle or a remote controlled toy robot.

Alternatively, the physical game participant can be a remote controlled aerial vehicle, such as an unmanned aerial vehicle (UAV) or a remote controlled balloon.

Alternatively, the physical game participant can be a remote controlled water vehicle, such as a remote controlled toy warship and a remote controlled toy motorboat and the like.

Alternatively, the physical game participant can also be a remote controlled underwater vehicle, such as a remote controlled toy fish or a remote controlled toy submarine.

In some embodiments, the physical game participant can be a ground stationery facility, such as a turret, a tower, or a wall in a simulated war game.

In some embodiments, the information can be one or more types of information of a physical game participant. For instance, the information can comprise at least one of a state information of the physical game participant, a control information of the physical game participant, or an identity information of the physical game participant.

The state information of the physical game participant can be a health point of the physical game participant, the physical game participant encountering a landmine, an obstacle or a trap, the physical game participant being frozen, or the physical game participant being dizzied.

In some instances, if the state information of the physical game participant is the health point, the state information can be generated when it is hit by an external visible light and/or invisible light. For example, a generation of the state information of the physical game participant can be triggered when the physical game participant is hit by an infrared light or laser. Optionally, the state information can be generated when the physical game participant is hit by a physical object, for example, a BB bullet.

The control information of the physical game participant can be a movement information of the physical game participant. For instance, the movement information of the physical game participant can comprise a movement of the physical game participant in a front direction, a rear direction, a left direction, a right direction, or an acceleration, a deceleration and the like. The control information of the physical game participant can be attack information of the physical game participant, for example, the physical game participant casting projectiles, laying landmines and the like.

The identity information of the physical game participant can be a participant category information, a battle achievement information and the like. For instance, the participant category information can comprise at least one of an attacker, a defender or a referee. The battle achievement information can comprise at least one of a time information and a quantity information. The quantity information can be a number of times hitting a counterpart physical game participant, a number of times destroying a counterpart physical game participant, a number of effective attacks and the like. The time information can be a duration of surviving, a duration of continuous attacking, a duration of continuous defensing and the like.

The information can be obtained in various manners. In some instances, the information can be obtained by a sensor provided on the physical game participant. Optionally, the information can be obtained by a sensor provided on a counterpart physical game participant. Optionally, the information can be obtained from a master controller.

In some embodiments, the lighting form can be a lighting color of the LED light-emitting device. Alternatively, the lighting form can be a lighting state of the LED light-emitting device. Alternatively, the lighting form can be an arrangement of light-emitting LEDs of the LED light-emitting device. Alternatively, the lighting form can be a lighting duration of the LED light-emitting device. The lighting form can be a combination of the above described forms.

For instance, if the information is the health point of the physical game participant and the LED light-emitting device is a RGB-LED, a change of the health point of the physical game participant can be displayed by controlling a change in a color of a plurality of RGB-LEDs.

Alternatively, if the information is the health point of the physical game participant and the LED light-emitting device is a monochromatic LED, a change of the health point of the physical game participant can be displayed by controlling a light-on or light-off of a plurality of monochromatic LEDs.

In some embodiments, the LED light-emitting device can be ordinary light-emitting diodes. Alternatively, the LED light-emitting device can be laser diodes. The ordinary light-emitting diode can be an organic light-emitting diode or an inorganic light-emitting diode.

In some embodiments, if multiple pieces of information are received, the multiple pieces of information can be sequentially displayed in different orders. For instance, if multiple pieces of information are obtained, the multiple pieces of information can be sequentially displayed by the LED light-emitting device in an order of receiving the information. Optionally, if multiple pieces of information are received, the multiple pieces of information can be sequentially displayed by the LED light-emitting device in an order of a preset priority.

Alternatively, if multiple pieces of information are received, the multiple pieces of information can be displayed simultaneously.

When new information is received, the new information can be displayed in various manners. For instance, when new information is received, the new information can be immediately displayed by the LED light-emitting device. Optionally, when new information is obtained, the new information can be immediately displayed by the LED light-emitting device, and a previous information can be displayed after a preset time period. Optionally, when new information is obtained, the new information can be displayed by the LED light-emitting device after a preset time period.

In some embodiments, when new information is received, the new information and a previous information can be displayed simultaneously.

The present disclosure further provides a display device which can implement the above described method of displaying. The display device can comprise an LED light-emitting device and an LED control circuit. The LED light-emitting device can comprise an LED light bar for generating a plurality of lighting forms. The LED control circuit can control the LED light bar, such that the LED light-emitting device can generate a lighting forms for displaying information of a physical game participant.

A structure of the LED light bar can be designed in view of actual requirements. For instance, the LED light bar can comprise an LED base plate and a plurality of LEDs disposed on the LED base plate. Optionally, the LED light bar can comprise a group of wires and a plurality of LEDs which are connected in parallel on the group of wires.

An arrangement of the plurality of LEDs can be designed in view of actual requirements. For instance, the plurality of LEDs can be arranged in a straight line, in a matrix, or in a combination thereof.

The present disclosure further provides a remote controlled vehicle. The remote controlled vehicle can comprise a display device, a sensing device and a controller. The sensing device can sense a state of the remote controlled vehicle and generate corresponding state information. The controller can receive the sensed state of the remote controlled vehicle and output a corresponding control signal to the LED control circuit based on the sense state. The LED control circuit can control the LED light-emitting device to generate lighting forms so as to display the information of the remote controlled vehicle.

In some embodiments, the sensing device can comprise a sensor which is disposed on an outer surface of the remote controlled vehicle. The sensor can sense whether an external projectile hits the outer surface of the remote controlled vehicle. The sensor can include an acceleration sensor, an infrared ray sensor, a motion sensor, a proximity sensor, a vision sensor, a position sensor, or a distance sensor.

In some embodiments, the LED control circuit of the display device and the controller can be integrated. Alternatively, the LED control circuit of the display device and the controller can be disposed separately.

In some embodiments, the state information can be a health point of the physical game participant. The controller can control the LED light-emitting device to generate lighting forms by the LED control circuit based on a change in the health point of the physical game participant. For instance, the LEDs can be RGB-LEDs, and the controller can change a lighting color of the plurality of RGB-LEDs by the LED control circuit based on a change in the health point of the physical game participant. Alternatively, the LEDs are monochrome LEDs, and the controller can control a light-on and a light-off of the plurality of monochrome LEDs by the LED control circuit based on a change in the health point of the physical game participant.

In some embodiments, if multiple pieces of information are received by the controller, the controller can display the multiple pieces of information in different orders. For instance, if multiple pieces of information are received by the controller, the controller can control the LED light-emitting device to sequentially display the multiple pieces of information in an order of receiving the information. Alternatively, if multiple pieces of information are received by the controller, the controller can control the LED light-emitting device to sequentially display the multiple pieces of information in an order of a preset priority.

Alternatively, if multiple pieces of information are obtained by the controller, the controller can control the LED light-emitting device to simultaneously display the multiple pieces of information.

When the controller receives new information, the controller can control the LED light-emitting device to display the new information in various manners.

For instance, when the controller receives new information, the controller can control the LED light-emitting device to immediately display the new information. Optionally, when the controller receives new information, the controller can control the LED light-emitting device to immediately display the new information, and display a previous information after a preset time period. Optionally, when the controller receives new information, the controller can control the LED light-emitting device to display the new information after a preset time period.

In some embodiments, when the controller receives new information, the controller can control the LED light-emitting device to display the new information and a previous information simultaneously.

Embodiments of the disclosure will be described with reference to the drawings.

Referring to FIG. 1, a display device 100 according to an embodiment of the present disclosure can display information of a physical game participant. The display device 100 can comprise an LED light-emitting device 101 and an LED control circuit 103.

The physical game participant can be various game devices for participating in a physical game. For example, the physical game participant can be a remote controlled ground vehicle, such as a remote controlled toy vehicle or a remote controlled toy robot. Alternatively, the physical game participant can be a remote controlled aerial vehicle, such as an unmanned aerial vehicle (UAV) or a remote controlled balloon. Alternatively, the physical game participant can be a remote controlled water vehicle, such as a remote controlled toy warship and a remote controlled toy motorboat and the like. Alternatively, the physical game participant can also be a remote controlled underwater vehicle, such as a remote controlled toy fish or a remote controlled toy submarine. Alternatively, the physical game participant can be a ground stationery facility, such as a turret, a tower, or a wall in a simulated war game.

The information of the physical game participant can be set according to actual requirements. For instance, the information can comprise at least one of a state information of the physical game participant, a control information of the physical game participant, or an identity information of the physical game participant.

The state information of the physical game participant can be a health point of the physical game participant, the physical game participant touching a landmine, an obstacle or a trap, the physical game participant being frozen, or the physical game participant being dizzied.

The control information of the physical game participant can be a movement information or an attack information of the physical game participant. For instance, the movement information of the physical game participant can comprise a movement of the physical game participant in a front direction, a rear direction, a left direction, a right direction, or an acceleration, a deceleration and the like.

The identity information of the physical game participant can be a participant category information, a battle achievement information and the like. For instance, the participant category information can comprise at least one of an attacker, a defender and a referee. The battle achievement information can comprise at least one of a time information and a quantity information. The quantity information can be a number of times hitting a counterpart physical game participant, a number of times destroying a counterpart physical game participant, a number of effective attacks and the like. The time information can be a duration of surviving, a duration of continuous attacking, a duration of continuous defensing and the like.

The LED light-emitting device 101 can comprise an LED light bar 110 for generating a plurality of lighting forms. A structure of the LED light bar 110 can be designed according to actual requirements.

In some instances, the lighting form can be a lighting sate of the LED light bar 110. For instance, the lighting state of the LED light bar 110 can be flashing, indicating that the physical game participant being hit.

Optionally, the lighting form can be an arrangement pattern of the light-emitting LEDs of the LED light bar 110. For instance, the light-emitting LEDs can be arranged as various characters or symbols, such as "victory", "!" and the like.

Optionally, the lighting form can be a lighting duration of the LED light bar 110. For instance, a survival time of a physical game participant can be displayed by the lighting duration of the LED light bar 110.

In some embodiments, each lighting form can correspond to one type of information of the corresponding physical game participant.

Figure 2:
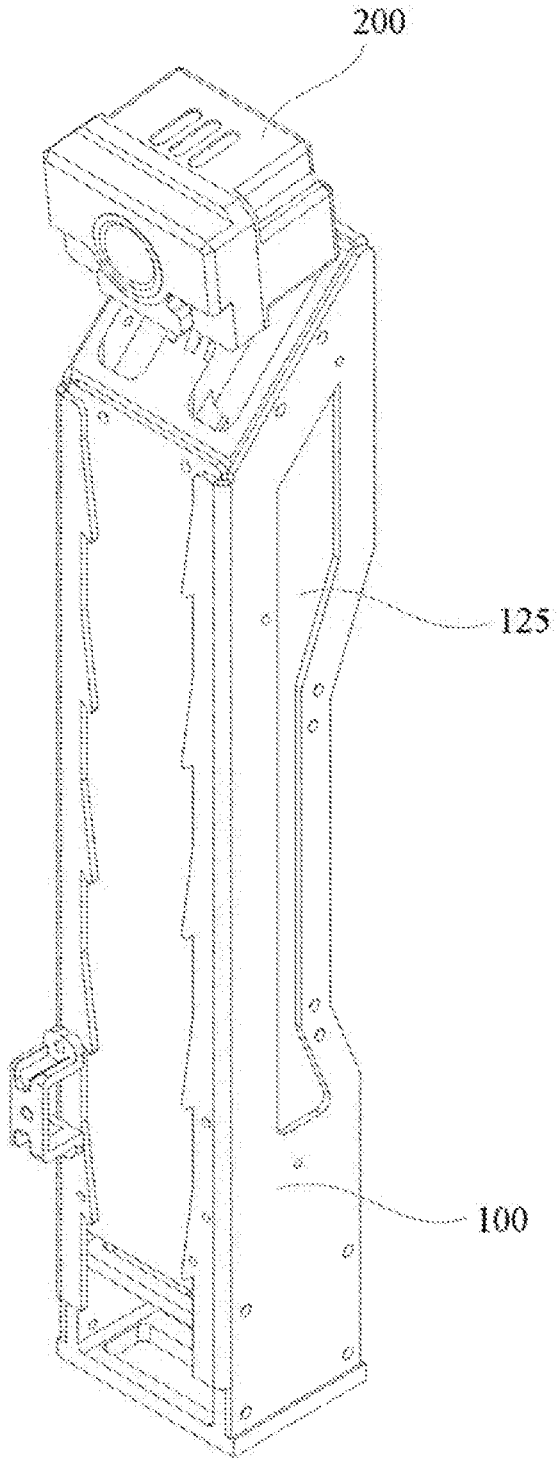
FIG. 2 is a perspective view of the display device in FIG. 1.
Figure 3:
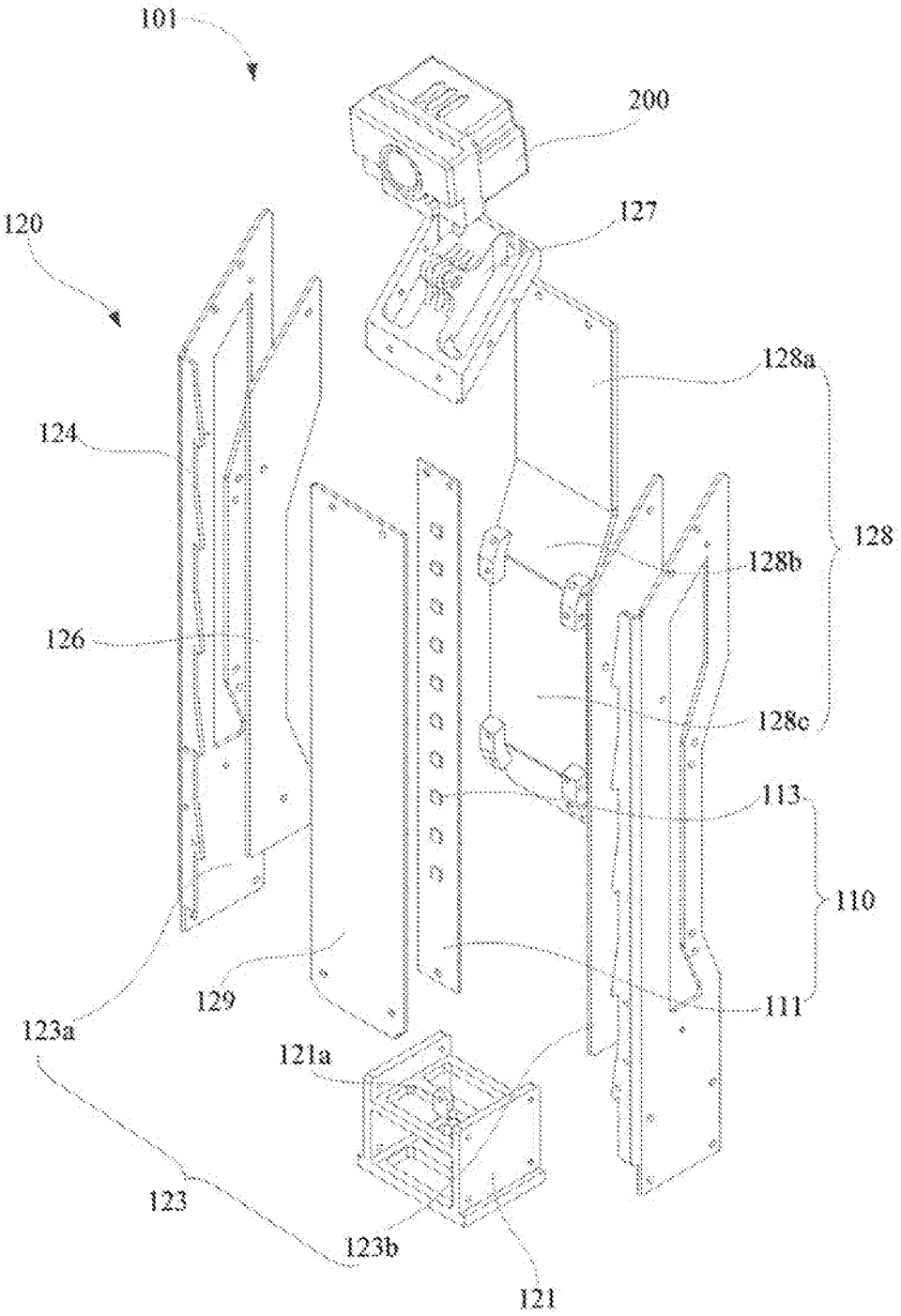
FIG. 3 is an exploded view of the display device in FIG. 2.

Referring to FIG. 2 and FIG. 3, in some embodiments, the LED light bar 110 can comprise an LED base plate 111 and a plurality of LEDs 113 disposed on the LED base plate 111. The plurality of LEDs 113 can be arranged in a straight line, in a matrix, or a combination thereof.

Alternatively, the LED light bar 110 can comprise a group of wires and the plurality of LEDs 113 which are connected in parallel on the group of wires. A plurality of LED light bars 110 can be provided in a row or in a matrix. The plurality of LEDs 113 can comprise at least an inorganic light-emitting diode or a laser diode.

Alternatively, the LED light bar 110 can be a light-emitting plate having a plurality of OLED light-emitting units. The LEDs 113 can be organic light-emitting diodes (OLEDs).

A structure of the LEDs 113 can be designed based on actual requirements. For instance, the plurality of LEDs 113 can be RGB-LEDs, monochrome LEDs, or a combination thereof.

In some instances, the LED light-emitting device 101 can comprise a housing 120 within which the LED light bar 110 is provided. The housing 120 can effectively protect the LED light bar 110.

The housing 120 can be provided in a cylinder structure, a flat plate structure, a truncated cone structure, a truncated prism structure, a prism structure, or an arc structure. In the illustrated exemplary embodiment, the housing 120 can comprises a base 121, a supporting frame 123, a light transmitting panel 125 (as shown in FIG. 2) and a top fixing member 127. Two ends of the supporting frame 123 can be fixedly connected with the base 121 and the top fixing member 127, respectively. The light transmitting panel 125 can be fixedly connected with the supporting frame 123 to form an enclosed light source chamber with the base 121 and the top fixing member 127. The LED light bar 110 can be received in the light source chamber.

In some instances, a lower fixing member 121*a* can be provided on the base 121, and an upper fixing member (not shown) can be provided on the top fixing member 127. Two ends of the LED base plate 111 can be fixedly connected with the upper fixing member of the top fixing member 127 and the lower fixing member 121 of the base 121, respectively, such that the LED base plate 111 can be fixed in the light source chamber.

The top fixing member 127 can be a seat for a camera, such that the camera 200 can be fixed. Alternatively, the top fixing member 127 can be other structures such as a flat plate.

A structure of the supporting frame 123 can be designed according to actual requirements. For instance, in the illustrated exemplary embodiment, the supporting frame 123 can comprise a left frame body 123*a* and a right frame body 123*b* which are disposed oppositely with a spacing. Two ends of the left frame body 123*a* and two ends of the right frame body 123*b* can be fixedly connected with the base 121 and the top fixing member 127, respectively.

The supporting frame 123 can be provided in other structures. For example, the supporting frame 123 can have a cubic frame body structure. For another example, the supporting frame 123 can comprise four columns which are disposed with a spacing therebetween.

In some instances, a plurality of light transmitting panels 125 can be provided. The light transmitting panels can comprise two first side plates 126, which are fixed on the left frame body 123*a* and the right frame body 123*b*, respectively.

The plurality of light transmitting panels 125 can comprise one second side plate 129, two ends of which are fixedly connected with the base 121 and the top fixing member 127, respectively. The second side plate 129 can be jointed to respective side of the two first side plates 126.

In some instances, a stopper 124 can be provided to a side of the left frame body 123*a* and a side of the right frame body 123*b*, respectively, the side of the left frame body 123*a* and the side of the right frame body 123*b* abutting against the second side plate 129. The stopper 124 can extend and bend from the edge of the left frame body 126 and the edge of the right frame body 127. The edges of the second side plate 129 can be secured by the stopper 124, such that a movement of the second side plate 129 can be limited, thereby improving a reliability of the structure of the LED light-emitting device 101.

In some instances, the plurality of light transmitting panels 125 can comprise a third side plate 128 which is disposed opposite to the second side plate 129. Two ends of the third side plate 128 can be fixedly connected with the base 121 and the top fixing member 127, respectively.

A configuration of the third side plate 128 can be designed based on actual requirements. For instance, in the illustrated embodiment, the third side plate 128 can comprise an upper plate 128*a*, a middle plate 128*b* and a lower plate 128*c*. One end of the middle plate 128*b* can be fixedly connected with the lower plate 128*c*, and the other end of the middle plate 128*b* can be connected with the upper plate 128*a* in a detachable manner. In case the LED light bar 110 within the housing 120 is to be replaced, the upper plate 128*a* can be detached to facilitate a maintenance of the LED light bar 110.

Alternatively, the third side plate 128 can be an integral plate.

It will be appreciated that, in the illustrated embodiment, the light transmitting panel 125 can be solid. The light transmitting panel 125 can be a transparent panel or a colored light transmitting panel 125. A plurality of light transmitting panels 125 can be jointed into an integral panel. Alternatively, the light transmitting panel 125 can be flexible. The light transmitting panel 125 can be an integral panel and provided around the supporting frame 123.

It will be appreciated that, the structure of the housing 120 is not limited to the illustrated embodiments. For instance, the housing 120 can have a cylindrical structure. The housing 120 can be transparent and have with two closed ends.

The LED control circuit 103 can be configured to control the plurality of LEDs 113 of the LED light-emitting device 101, such that the LED light-emitting device 101 can generate lighting forms for displaying information of the physical game participant.

The display device 100 for displaying information of a physical game participant of present disclosure is advantageous over conventional art.

In an aspect, the display device 100 can display information of the physical game participant by lighting of the LED light-emitting device 101. The LED light-emitting device 101 can be fixed directly on the physical game participant, such that a viewer can know intuitively information of the physical game participant. For instance, state information of the physical game participant, such as health point, can be displayed by the LED light-emitting device 101, such that the health point of the physical game participant can be directly known.

In another aspect, the display device 100 can control the LED light-emitting device 101 to generate various lighting forms by the LED control circuit 103, such that various information of the physical game participant can be displayed and an applicability is improved.

The present disclosure further provides a method of displaying which can be applied to the above described display device.

Figure 4:
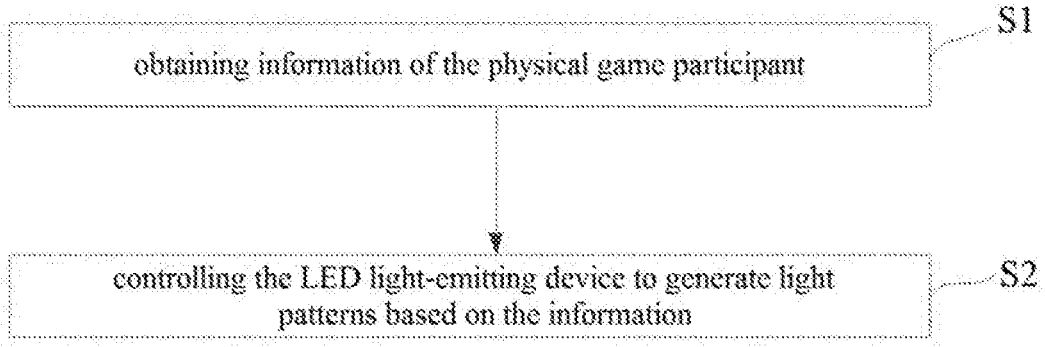
FIG. 4 is a flow chart of a method for displaying information of a physical game participant according to an embodiment of the disclosure.
Figure 5:
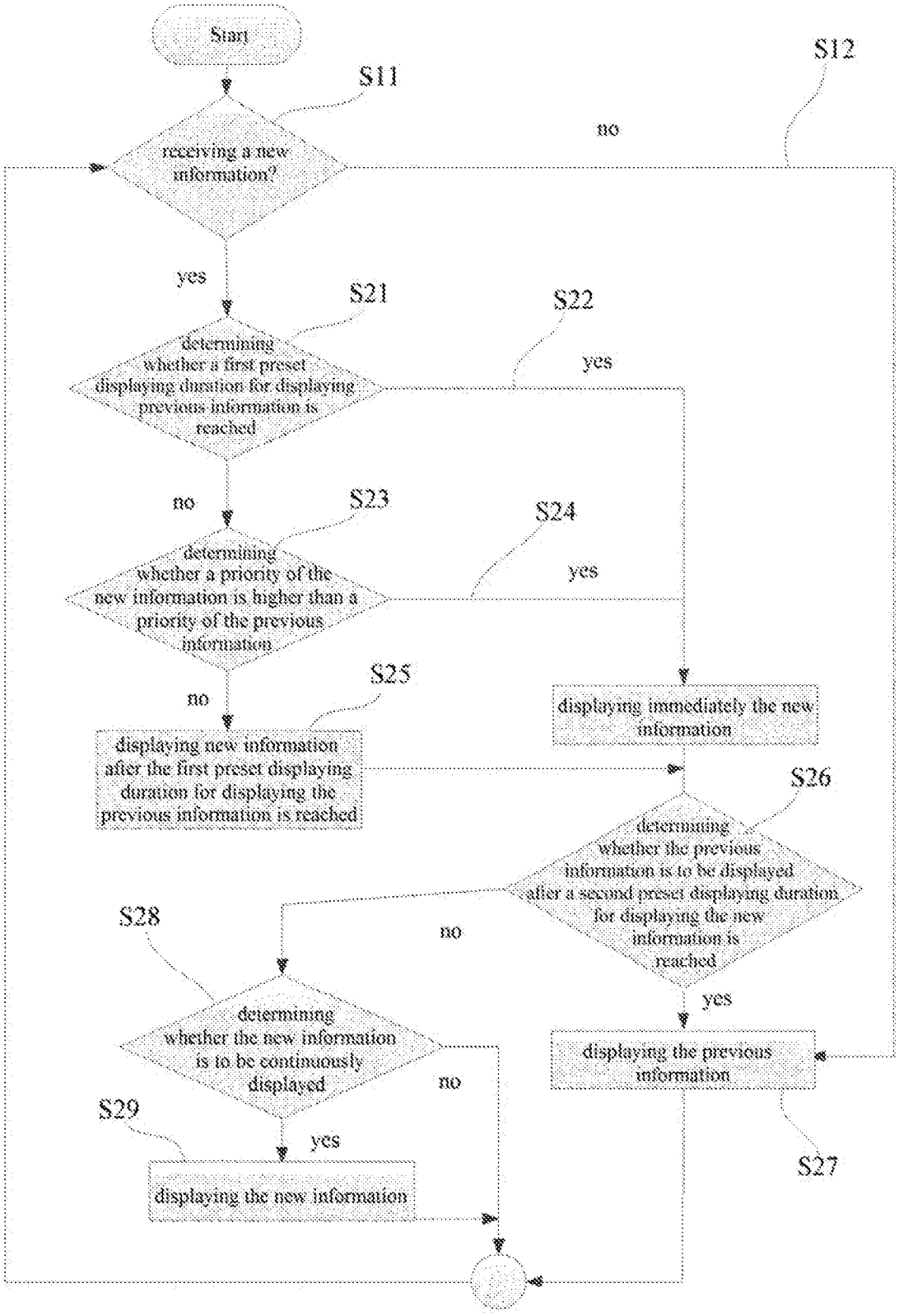
FIG. 5 is a flow chart of the displaying method for displaying information of a physical game participant in FIG. 4.

Referring to FIG. 4 and FIG. 5, a method for displaying information of a physical game participant, according to an embodiment of the present disclosure, can comprise processes S1 to S2.

In process S1, information of the physical game participant can be obtained.

The physical game participant can be various game devices for participating in a physical game. For example, the physical game participant can be a remote controlled ground vehicle, such as a remote controlled toy vehicle or a remote controlled toy robot. Alternatively, the physical game participant can be a remote controlled aerial vehicle, such as an unmanned aerial vehicle (UAV) or a remote controlled balloon. Alternatively, the physical game participant can be a remote controlled water vehicle, such as a remote controlled toy warship and a remote controlled toy motorboat and the like. Alternatively, the physical game participant can also be a remote controlled underwater vehicle, such as a remote controlled toy fish or a remote controlled toy submarine. Alternatively, the physical game participant can be a ground stationery facility, such as a turret, a tower, or a wall in a simulated war game.

The information of the physical game participant can be set according to actual requirements. For instance, the information can comprise at least one of a state information of the physical game participant, a control information of the physical game participant, or an identity information of the physical game participant.

The state information of the physical game participant can be a health point of the physical game participant, the physical game participant touching a landmine, an obstacle or a trap, the physical game participant being frozen, or the physical game participant being dizzied.

The control information of the physical game participant can be a movement information or an attack information of the physical game participant. For instance, the movement information of the physical game participant can comprise a movement of the physical game participant in a front direction, a rear direction, a left direction, a right direction, or an acceleration, a deceleration and the like.

The identity information of the physical game participant can be a participant category information, a battle achievement information and the like. For instance, the participant category information can comprise at least one of an attacker, a defender and a referee. The battle achievement information can comprise at least one of a time information and a quantity information.

The quantity information can be a number of times hitting a counterpart physical game participant, a number of times destroying a counterpart physical game participant, a number of effective attacks and the like. The time information can be a duration of surviving, a duration of continuous attacking, a duration of continuous defensing and the like.

The information of the physical game participant can be obtained by various manners. In some instances, the information of the physical game participant can be obtained by a sensor provided on the physical game participant. For instance, the sensor provided on the physical game participant can sense whether an external projectile hits the physical game participant. Optionally, the information of the physical game participant can be obtained by a sensor provided on a counterpart physical game participant. For instance, information on how many times the counterpart physical game participant is hit can be received from the sensor provided on the counterpart physical game participant. Optionally, the information of the physical game participant can be obtained from a master controller. For instance, information on how many counterpart physical game participants are destroyed can be received from the master controller.

The process S1 can be implemented in various manners. In some embodiments, the process S1 can comprise processes S11 to S12.

In process S11, a determination can be made on whether new information is received.

In process S12, previous information can be displayed by the LED light-emitting device 101 if no new information is received. A next process can be performed if new information is received.

In process S2, the LED light-emitting device 101 can be controlled to generate light patterns based on the information.

In some instances, the lighting form can be a lighting color of the LED light-emitting device 101. Different information can be displayed by different lighting color of the LED light-emitting device 101. For instance, the LED light-emitting device 101 can emit a red light to indicate that the physical game participant is an attacker, and the LED light-emitting device 101 can emit a blue light to indicate that the physical game participant is a defender.

Optionally, the lighting form can be a lighting state of the LED light-emitting device 101. For instance, the lighting state of the LED light-emitting device 101 can be flashing to indicate that the physical game participant being hit.

Optionally, the lighting form can be an arrangement pattern of the light-emitting LEDs of the LED light-emitting device 101. For instance, the light-emitting LEDs can be arranged as various characters or symbols, such as "victory", "!" and the like.

Optionally, the lighting form can be a lighting duration of the LED light-emitting device 101. For instance, the survival time of the physical game participant can be displayed by the lighting duration of the LED light-emitting device 101.

The LED light-emitting device 101 can comprise an LED light bar 110 for generating various lighting forms. A specific structure of the LED light bar 110 can be designed according to actual requirements.

Referring back to FIG. 2 and FIG. 3, in the illustrated embodiment, the LED light bar 110 can comprise an LED base plate 111 and a plurality of LEDs 113 disposed on the LED base plate 111. The plurality of LEDs 113 can be arranged in a straight line, in a matrix, or a combination thereof. Alternatively, the LED light bar 110 can comprise a group of wires and the plurality of LEDs 113 which are connected in parallel on the group of wires. A plurality of LED light bars 110 can be provided in a row or in a matrix. The plurality of LEDs 113 can comprise at least an inorganic light-emitting diode or a laser diode.

Alternatively, the LED light bar 110 can be a light-emitting plate having a plurality of OLED light-emitting units. The LEDs 113 can be organic light-emitting diodes (OLEDs).

A structure of the LEDs 113 can be designed based on actual requirements. For instance, the plurality of LEDs 113 can be RGB-LEDs, monochrome LEDs, or a combination thereof.

In some instances, the LED light-emitting device 101 can comprise a housing 120 within which the LED light bar 110 is provided. The housing 120 can effectively protect the LED light bar 110.

The housing 120 can be provided in a cylinder structure, a flat plate structure, a truncated cone structure, a truncated prism structure, a prism structure, or an are structure. In the illustrated exemplary embodiment, the housing 120 can comprises a base 121, a supporting frame 123, a light transmitting panel 125 and a top fixing member 127. Two ends of the supporting frame 123 can be fixedly connected with the base 121 and the top fixing member 127, respectively. The light transmitting panel 125 can be fixedly connected with the supporting frame 123 to form an enclosed light source chamber with the base 121 and the top fixing member 127. The LED light bar 110 can be received in the light source chamber.

In some instances, a lower fixing member 121*a* can be provided on the base 121, and an upper fixing member (not shown) can be provided on the top fixing member 127. Two ends of the LED base plate 111 can be fixedly connected with the upper fixing member of the top fixing member 127 and the lower fixing member 121*a* of the base 121, respectively, such that the LED base plate 111 can be fixed in the light source chamber.

The top fixing member 127 can be a seat for a camera, such that the camera 200 can be fixed. Alternatively, the top fixing member 127 can be other structures such as a flat plate.

A structure of the supporting frame 123 can be designed according to actual requirements. For instance, in the illustrated exemplary embodiment, the supporting frame 123 can comprise a left frame body 123*a* and a right frame body 123*b* which are disposed oppositely with a spacing. Two ends of the left frame body 123*a* and two ends of the right frame body 123*b* can be fixedly connected with the base 121 and the top fixing member 127, respectively.

The supporting frame 123 can be provided in other structures. For example, the supporting frame 123 can have a cubic frame body structure. For another example, the supporting frame 123 can comprise four columns which are disposed with a spacing therebetween.

In some instances, a plurality of light transmitting panels 125 can be provided. The light transmitting panels can comprise two first side plates 126, which are fixed on the left frame body 123*a* and the right frame body 123*b*, respectively.

The plurality of light transmitting panels 125 can comprise one second side plate 129, two ends of which are fixedly connected with the base 121 and the top fixing member 127, respectively. The second side plate 129 can be jointed respective side of the two first side plates 126.

In some instances, a stopper 124 can be provided to a side of the left frame body 123*a* and a side of the right frame body 123*b* which abut against the second side plate 129. The stopper 124 can extend and bend from the edge of the left frame body 126 and the edge of the right frame body 127. The edges of the second side plate 129 can be secured by the stopper 124, such that a movement of the second side plate 129 can be limited, thereby improving a reliability of the structure of the LED light-emitting device 101.

In some instances, the plurality of light transmitting panels 125 can comprise a third side plate 128 which is disposed opposite to the second side plate 129. Two ends of the third side plate 128 can be fixedly connected with the base 121 and the top fixing member 127, respectively.

A configuration of the third side plate 128 can be designed based on actual requirements. For instance, in the illustrated embodiment, the third side plate 128 can comprise an upper plate 128*m*, a middle plate 128*b* and a lower plate 128*c*. One end of the middle plate 128*b* can be fixedly connected with the lower plate 128*c*, and the other end of the middle plate 128*b* can be connected with the upper plate 128*a* in a detachable manner. In case the LED light bar 110 within the housing 120 is to be replaced, the upper plate 128*a* can be detached to facilitate a maintenance of the LED light bar 110.

Alternatively, the third side plate 128 can be an integral plate.

It will be appreciated that, in the illustrated embodiment, the light transmitting panel 125 can be solid. The light transmitting panel 125 can be a transparent panel or a colored light transmitting panel 125. A plurality of light transmitting panels 125 can be jointed into an integral panel. Alternatively, the light transmitting panel 125 can be flexible. The light transmitting panel 125 can be an integral panel and provided around the supporting frame 123.

It will be appreciated that, the structure of the housing 120 is not limited to the illustrated embodiments. For instance, the housing 120 can have a cylindrical structure. The housing 120 can be transparent and have with two closed ends.

Information of the physical game participant can be displayed by the LED light-emitting device 101, such that game participants can easily observe. In some embodiments, the information can be health point of the physical game participant. The LEDs 113 can be RGB-LEDs. A change in a lighting color of the plurality of RGB-LEDs can be controlled to display a change in the health point of the physical game participant. For instance, the lighting color of the plurality of RGB-LEDs can be controlled as red or green, where a red color can indicate a blood decreasing, and a green color can indicate a blood increasing. The health point can be indicated by a number of green LEDs.

Alternatively, the information can be health point of the physical game participant. The LEDs 113 can be monochrome LEDs. A light-on and light-off of the plurality of monochrome LEDs can be controlled to display a change in the health point of the physical game participant.

If multiple pieces of information are received, the multiple pieces of information can be displayed in various manners. In some embodiments, the received multiple pieces of information can be sequentially displayed by the LED light-emitting device 101 in an order of receiving the information. For instance, if a state information "being shot" is first received, and a control information "moving forward" is later received, the state information "being shot" can be first displayed and the control information "moving forward" can be later displayed in an order of receiving the information.

Alternatively, the received multiple pieces of information can be sequentially displayed by the LED light-emitting device 101 in an order of a preset priority. For instance, if a state information "being shot" is first received and a control information "moving forward" is later received, the control information "moving forward" can be first displayed and the state information "being shot" can be later displayed if the control information has a higher priority than the state information.

Alternatively, the received multiple pieces of information can be displayed simultaneously by the LED light-emitting device 101. For instance, if a state information "being shot" is first received, and a control information "moving forward" is later received, the state information "being shot" and the control information "moving forward" can be displayed simultaneously by the LED light-emitting device 101.

When new information is received, the new information and previous information can be displayed in various manners. In some embodiments, when the new information is received, the new information can be immediately displayed by the LED light-emitting device 101. For instance, if a state information "being shot" of a physical game participant is received, the health point of the physical game participant being decreased by a preset value can immediately displayed by the LED light-emitting device 101.

Alternatively, when new information is received, the new information can be immediately displayed by the LED light-emitting device 101, the previous information can be displayed again after a preset time period. For instance, when a state information "being shot" (e.g., new information) of the physical game participant is received, the state information "being shot" of the physical game participant can be immediately displayed by the LED light-emitting device 101, and after a preset time period, the battle achievement information "number of destroyed enemies" (e.g., previous information) can be displayed again.

Alternatively, when new information is received, the new information can be displayed by the LED light-emitting device 101 after a preset time period. For instance, if there is a change in battle achievement information "number of destroyed enemies" of the physical game participant, the battle achievement information "number of destroyed enemies" of the physical game participant can be displayed by the LED light-emitting device 101 after a preset time period.

Alternatively, when new information is received, the new information can be immediately displayed by the LED light-emitting device 101, and the previous information can be displayed simultaneously. For instance, when the state information "being shot" (e.g., new information) of the physical game participant is received, the state information "being shot" of the physical game participant can be immediately displayed by the LED light-emitting device 101, and the battle achievement information "number of destroyed enemies" (e.g., previous information) can be displayed simultaneously.

The process S2 can be implemented in various manners. In some embodiments, the process S2 can comprise processes S21 to S25.

In process S21, a determination can be made on whether a first preset displaying duration for displaying previous information is reached.

In process S22, new information can be immediately displayed by the LED light-emitting device 101 if the first preset displaying duration for displaying the previous information is reached.

In process S23, a determination can be made on whether a priority of the new information is higher than a priority of the previous information if the first preset displaying duration for displaying the previous information is not reached.

In process S24, the new information can be immediately displayed by the LED light-emitting device 101 if the priority of the new information is higher than the priority of the previous information.

In process S25, the new information can be displayed by the LED light-emitting device 101 after the first preset displaying duration for displaying the previous information is reached, if the priority of the new information is not higher than the priority of the previous information.

In some embodiments, subsequent to the process S25, the process S2 can further comprise the processes S26 to S29.

In process S26, a determination can be made on whether the previous information is to be displayed again after a second preset displaying duration for displaying the new information is reached.

In process S27, the previous information can be immediately displayed by the LED light-emitting device 101 again if it is determined that the previous information is to be displayed again.

In process S28 a determination can be made on whether the new information is to be continuously displayed if it is determined that the previous information is not to be displayed again.

In process S29, if it is determined that the new information is to be continuously displayed, the new information can be continuously displayed by the LED light-emitting device 101.

The method for displaying information of the physical game participant of present disclosure is advantageous over conventional art.

In an aspect, with the method for displaying information, information of the physical game participant can be displayed by lighting of the LED light-emitting device 101. The LED light-emitting device 101 can be fixed directly on the physical game participant, such that a viewer can know intuitively information of the physical game participant. For instance, state information of the physical game participant, such as health point, can be displayed by the LED light-emitting device 101, such that the health point of the physical game participant can be directly known.

In another aspect, with the method for displaying information, the LED light-emitting device 101 can be controlled to generate various lighting forms by the LED control circuit 103, such that various information of the physical game participant can be displayed and an applicability is improved.

The present disclosure further provides a remote controlled vehicle, in which the display device 100 is applied.

Figure 6:
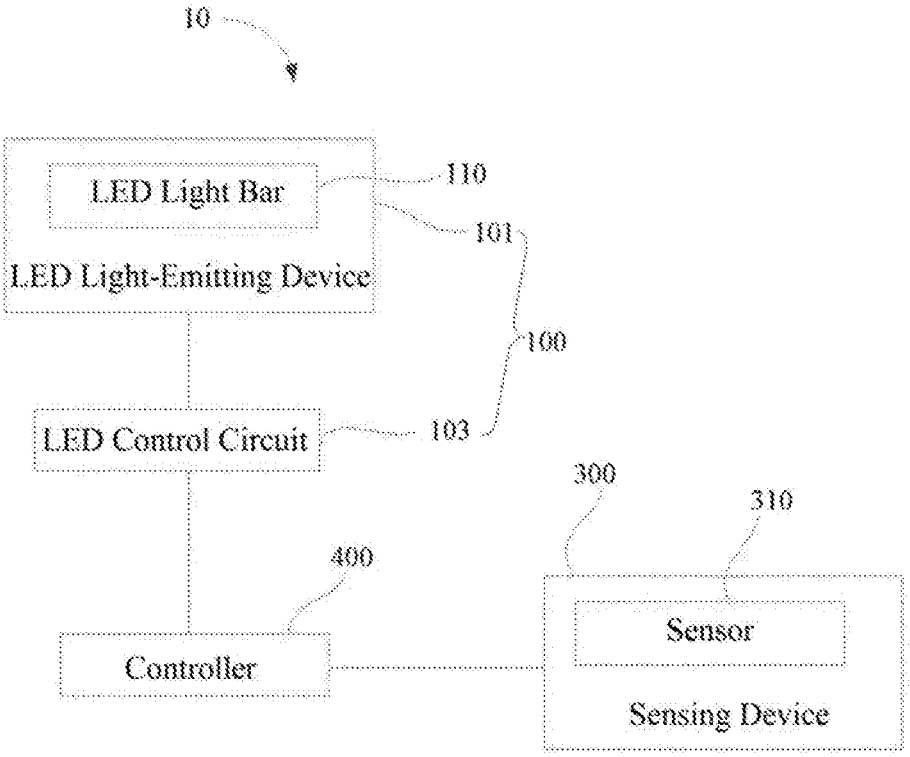
FIG. 6 is a circuit diagram of a remote controlled vehicle according to an embodiment of the disclosure.

Referring to FIG. 6, the remote controlled vehicle 10 according to an embodiment of the present disclosure can comprise a display device 100, a sensing device 300 and a controller 400. A specific structure of the display device 100 is described hereinabove in exemplary embodiments.

The sensing device 300 can be configured to sense a state of the remote controlled vehicle 10 and generate a corresponding state information. A structure of the sensing device 300 can be designed according to actual requirements. In the illustrated embodiment, the sensing device 300 can comprise a sensor 310 which is disposed on an outer surface of the remote controlled vehicle 10. The sensor 310 can sense whether an external projectile hits the outer surface of the vehicle.

The sensor 310 can include an acceleration sensor, an infrared ray sensor, a motion sensor, a proximity sensor, a vision sensor, a position sensor, a distance sensor and the like. In some instances, the sensor 310 can comprise any combination of the sensors.

The controller 400 can be in a communication connection with an LED control circuit 103 of the display device 100 and the sensing device 300. The controller 400 can receive a state information and output a corresponding control signal to the LED control circuit 103 based on the received state information.

A specific structure of the controller 400 can be designed according to actual requirements. For instance, the controller 400 can be a microprocessor, a control circuit board, or an IC controller. In some instances, the controller 400 can comprise any combination of a microprocessor, a control circuit board or an IC controller. The controller 400 and the LED control circuit 103 can be integrated. Optionally, the controller 400 can be separately provided from the LED control circuit 103.

The state information of the remote controlled vehicle 10 can comprise at least one of a health point, touching a landmine, an obstacle or a trap, being frozen, or being dizzied.

If the controller 400 receives multiple pieces of state information, the controller 400 can control the LED light-emitting device 101 to display the multiple pieces of state information in various manners.

In some embodiments, if the controller 400 receives multiple pieces of state information, the controller 400 can control the LED light-emitting device 100 to sequentially display the multiple pieces of state information in an order of receiving the information. For instance, if the controller 400 first receives a state information "touching landmine" and later a state information "health point", the controller 400 can, in an order of receiving the information, control the LED light-emitting device 101 to first display the state information "touching landmine" and later the state information "health point".

Alternatively, if the controller 400 receives multiple pieces of state information, the controller 400 can, in an order of a preset priority of the state information, control the LED light-emitting device 101 to simultaneously display the multiple pieces of state information. For instance, if the controller 400 first receives a state information "being dizzied" and later a state information "touching landmine", the controller 400 can, in an order of a preset priority that the state information "touching landmine" being higher than the state information "being dizzied", control the LED light-emitting device 101 to first display the state information "touching landmine" and later the state information "being dizzied".

Alternatively, if the controller 400 receives multiple pieces of state information, the controller 400 can control the LED light-emitting device 101 to simultaneously display the multiple pieces of state information. For instance, if the controller 400 first receives the state information "being dizzied" and later the state information "touching landmine", the controller 400 can control the LED light-emitting device 101 to simultaneously display the state information of "touching landmine" and the state information of "being dizzied".

When the controller 400 receives new state information, the controller 400 can display the new state information and previous state information in various manners.

In some embodiments, when the controller 400 receives new state information, the controller 400 can control the LED light-emitting device 101 to immediately display the new state information. For instance, when the controller 400 receives new state information "touching landmine", the controller 400 can control the LED light-emitting device 101 to immediately display the new state information.

Alternatively, when the controller 400 receives new state information, the controller 400 can control the LED light-emitting device 101 to immediately display the new state information, and after a preset time period, the controller 400 can control the LED light-emitting device 101 to display the previous state information again. For instance, when the controller 400 receives new state information "touching landmine", the controller 400 can control the LED light-emitting device 101 to immediately display the new state information "touching landmine", and control the LED light-emitting device 101 to display the previous state information "being dizzied" again after a preset displaying duration period for displaying the new state information "touching landmine" is reached.

Alternatively, when the controller 400 receives new state information, the controller 400 can control the LED light-emitting device 101 to display the new state information after a preset time period. For instance, when the controller 400 receives new state information "touching landmine", the controller 400 can control the LED light-emitting device 101 to display the new state information "touching landmine" after a preset displaying duration for displaying the previous state information "being dizzied" is reached.

Alternatively, when the controller 400 receives new state information, the controller 400 can control the LED light-emitting device 101 to display the previous state information and new state information simultaneously. For instance, when the controller 400 receives new state information "touching landmine", the controller 400 can control the LED light-emitting device 101 to immediately display the new state information "touching landmine" and the previous state information "being dizzied".

When the state information the remote controlled vehicle 10 is a health point of the remote controlled vehicle 10, the health point of the remote controlled vehicle 10 can be displayed based on a structure of the LEDs 113 of the LED light-emitting device 101.

In some embodiments, the state information can be health point of the remote controlled vehicle 10, and the LEDs can be RGB-LEDs. The controller 400 can change a lighting color of the plurality of RGB-LEDs by the LED control circuit 103 based on a change in the health point of the remote controlled vehicle 10. For instance, the lighting color of the plurality of RGB-LEDs can be controlled as red or green, where a red color can indicate a blood decreasing, and a green color can indicate a blood increasing. The health point can be indicated by a number of green LEDs.

Alternatively, the state information can be health point of the remote controlled vehicle 10, and the LEDs can be monochrome LEDs. The controller 400 can control a light-on and light-off of the plurality of monochrome LEDs by the LED control circuit 103 based on a change in the health point of the remote controlled vehicle 10.

The remote controlled vehicle 10 of present disclosure is advantageous over conventional art.

In an aspect, in the remote controlled vehicle 10, information of the physical game participant can be displayed by lighting of the LED light-emitting device 101. The LED light-emitting device 101 can be fixed directly on the physical game participant, such that a viewer can know intuitively information of the physical game participant. For instance, state information of the physical game participant, such as health point, can be displayed by the LED light-emitting device 101, such that the health point of the physical game participant can be directly known.

In another aspect, in the remote controlled vehicle 10, the LED light-emitting device 101 can be controlled to generate various lighting forms by the LED control circuit 103, such that various information of the physical game participant can be displayed and an applicability is improved.

In still another aspect, in the remote controlled vehicle 10, the controller 400 can control the LED light-emitting device 101 to display multiple pieces of state information of the remote controlled vehicle in different orders and/or different patterns by the LED control circuit 103, such that a manipulation of the remote controlled vehicle 10 is easier.

It will be appreciated that, in the embodiments described hereinabove, the disclosed devices and methods can be implemented by various ways. For instance, the above-described device embodiments are merely schematic. For example, a division of the modules or units is merely a division in logic function, and other division manners of the modules or units can be otherwise implemented. In some instances, a plurality of units or components can be combined or integrated into another system. Optionally, some features can be omitted or not performed. Furthermore, a coupling, a direct coupling or a direct communication connection between modules can be an indirect coupling or an indirect communication connection via an interface. An indirect coupling or a communication connection between modules can be in electrical coupling, mechanical coupling or a coupling in other forms.

Units described as separate part can or cannot be physically separated. Components shown as units can or cannot be physical units, for instance, they can be located in one place, or can be distributed into a plurality of network units. Some or all of the units can be selected to achieve the objects of the embodiments in view of actual requirements.

Various functional units described in various embodiments of the present disclosure can be integrated into one processing unit. Optionally, the various functional units can be physical individuals. Two or more of the various function units can be integrated into one unit. The integrated unit can be implemented in a form of hardware or in a form of software functional units.

If integrated units are implemented in a form of software functional units and sold or used as independent products, they can be stored in a computer readable storage medium. In this concept, the technical solution of the present disclosure, or a part of the technical solution which contributes over the prior art, or some or all of the technical solution, can be embodied in a form of a software product. The software product can be stored in a storage medium. The software product can comprise instructions which cause a computer processor to execute some or all of the processes of methods in various embodiments of the present disclosure. The above-mentioned storage medium can comprise various medium capable of storing program codes, such as a USB flash disk, a movable hard disc, a Read-Only Memory (ROM), a random access memory (RAM), a diskette or an optical disc.

The foregoing disclosure is merely illustrative of the embodiments of the disclosure but not intended to limit the scope of the disclosure. Any equivalent modifications to a structure or process flow, which are made without departing from the specification and the drawings of the disclosure, and a direct or indirect application in other relevant technical fields, shall also fall into the scope of the disclosure.

What is claimed is:

1. A method for displaying information of a physical game participant, comprising:

obtaining, in a sequence, multiple pieces of information of the physical game participant in a battle, the multiple pieces of information including a first piece of information and a second piece of information;

determining, based on a preset priority of each of the first piece of information and the second piece of information and the sequence, an order to display the first piece of information and the second piece of information; and controlling, based on the multiple pieces of information, a light-emitting diode (LED) device to generate a corresponding lighting form to display the first piece of information and the second piece of information in the order, to allow a viewer of the battle to view the first piece of information and the second piece of information of the physical game participant.

2. The method of claim 1, wherein the multiple pieces of information comprise at least one of state information of the physical game participant, control information of the physical game participant or identity information of the physical game participant.

3. The method of claim 1, wherein the multiple pieces of information are obtained from at least one of a sensor provided on the physical game participant, a sensor provided on a counterpart physical game participant, or a master controller.

4. The method of claim 1, wherein the physical game participant comprises at least one of a remote controlled water vehicle, a remote controlled underwater vehicle, a remote controlled aerial vehicle, a remote controlled ground vehicle, or a ground stationery facility.

5. The method of claim 1, wherein the lighting form comprises at least one of a lighting color of the LED device, a lighting state of the LED device, an arrangement of LEDs of the LED device, or a lighting duration of the LED device.

6. The method of claim 1, wherein the LED device comprises an LED light bar having a plurality of LEDs, wherein:

the plurality of LEDs comprise at least one of an inorganic LED or a laser diode, and the LED light bar further comprises an LED base plate on which the plurality of LEDs are disposed; or the plurality of LEDs are organic LEDs (OLEDs), the LED light bar being a light-emitting plate having a plurality of light-emitting units of the plurality of OLEDs.

7. The method of claim 6, wherein the LED device further comprises a housing within which the LED light bar is mounted.

8. The method of claim 7, wherein the housing comprises a base, a supporting frame, a light transmitting panel and a top fixing member, wherein two ends of the supporting frame are fixedly connected with the base and the top fixing member, respectively, the light transmitting panel is fixedly connected with the supporting frame to form an enclosed light source chamber with the base and the top fixing member, and wherein the LED light bar is received within the light source chamber.

9. The method of claim 8, wherein the top fixing member is a seat for a camera.

10. A remote controlled vehicle, comprising:

a display device for displaying information of a physical game participant in a battle, comprising:

a light-emitting diode (LED) device comprising an LED light bar for generating a plurality of lighting forms; and an LED control circuit for controlling the LED light bar to generate light;

a sensing device for sensing a state of the remote controlled vehicle and generating corresponding state information; and a controller in communication connection with the LED control circuit and the sensing device, the controller being configured to:

obtain, in a sequence, multiple pieces of information including the state information, the multiple pieces of information including a first piece of information and a second piece of information;

determine, based on a preset priority of each of the first piece of information and the second piece of information and the sequence, an order to display the first piece of information and the second piece of information; and output, based on the multiple pieces of information, a control signal to the LED control circuit, wherein in response to receiving the control signal, the LED control circuit controls the LED bar of the LED device to generate a corresponding light form to display the first piece of information and the second piece of information in the order, to allow a viewer of the battle to view the first piece of information and the second piece of information of the physical game participant.

11. The remote controlled vehicle of claim 10, wherein the sensing device comprises a sensor disposed on an outer surface of the remote controlled vehicle, the sensor sensing whether an external projectile hits the outer surface of the remote controlled vehicle.

12. The remote controlled vehicle of claim 11, wherein the sensor comprises at least one of an acceleration sensor, an infrared ray sensor, a motion sensor, a proximity sensor, a vision sensor, a position sensor, or a distance sensor.

13. The remote controlled vehicle of claim 10, wherein the state information is a health point of the remote controlled vehicle and the LEDs are RGB-LEDs, and wherein the controller changes a lighting color of the plurality of RGB-LEDs by the LED control circuit based on a change in the health point of the remote controlled vehicle; or wherein the state information is the health point of the remote controlled vehicle and the LEDs are monochrome LEDs, and wherein the controller controls a light-on and a light-off of the plurality of monochrome LEDs by the LED control circuit based on a change in the health point of the remote controlled vehicle.

14. The remote controlled vehicle of claim 10, wherein when the controller receives a new piece of information, the controller controls the LED device to:

immediately display the new piece of information; or immediately display the new piece of information, and display previous state information after a first preset time period; or display the new piece of information after a second preset time period.

15. The remote controlled vehicle of claim 10, wherein the controller and the LED control circuit are integrated or separately disposed.

16. The remote controlled vehicle of claim 10, wherein the state information of the remote controlled vehicle comprises at least one of a health point, touching landmine, obstacle or trap, being frozen, or being dizzied.

17. The remote controlled vehicle of claim 10, wherein the controller comprises at least one of a microprocessor, a control circuit board, or an IC controller.

* * * * *